US005983748A

United States Patent [19]

Ueno

[11] Patent Number: 5,983,748

[45] Date of Patent: Nov. 16, 1999

[54] OPERATING DEVICE

[75] Inventor: Hiroshi Ueno, Aichi, Japan

[73] Assignee: Kabushiki Kaisha Tokai Rika Denki Seisakusho, Aichi, Japan

[21] Appl. No.: 08/908,177

[22] Filed: Aug. 7, 1997

[30] Foreign Application Priority Data

Aug. 8, 1996 [JP] Japan ..... 8-209798

[51] Int. Cl.[6] ..... H01H 3/12

[52] U.S. Cl. ..... 74/553; 200/529

[58] Field of Search ..... 74/553, 10 R; 200/529, 521, 526, 527, 528, 533

[56] References Cited

U.S. PATENT DOCUMENTS 5,626,223 5/1997 Lee ..... 200/529

FOREIGN PATENT DOCUMENTS 227427 9/1943 Switzerland ..... 200/529

*Primary Examiner*—John A. Jeffery
*Assistant Examiner*—Mary Ann Battista
*Attorney, Agent, or Firm*—Morgan, Lewis & Bockius LLP

[57] ABSTRACT

A switch device 1 has an outer frame 2, and a rotor 13 . A spring 14 is provided between the bottom 7 of the outer frame 2 and the rotor 13 in such a manner that its two ends are secured to the outer frame 2 and the rotor 13. The rotor 13 is operated with the aid of an operating knob 3. The bottom 7 has first and second body-side protrusions 9 and 10 which have sloped surfaces, and steps, and are arcuate. The rotor 13 has first and second operating-element-side protrusions 19 and 20 with respect to the body-side protrusions 9 and 10 which have sloped surface and steps and are arcuate. The rotor 13 has a rod 18. As the rotor 1 is operated, the rod 18 is protruded from a through-hole 8, thus performing a switching operation. When the switch device 1 is operated, the force of operation of the operating knob 3 is improved, being the sum of a frictional force attributing to the slip between the sloped surfaces of the protrusions 9 and 10 and the sloped surfaces of the protrusions 19 and 20.

20 Claims, 4 Drawing Sheets

OPERATING DEVICE

BACKGROUND OF THE INVENTION

1. Field of the Invention

This invention relates to an operating device which is operated by depressing an operating element.

2. Related Art

Unexamined Japanese Patent Application Hei 7-2388063 has disclosed a switch device in which an operating protrusion is formed on its operating shaft side, and a rotary protrusion is formed on its rotary element side. The operating protrusion, and the rotary protrusion have linearly sloped surfaces which are abutted against each other. When the operating knob is depressed against the elastic force of a return spring interposed between the operating knob and a switch body, the operating protrusion and the rotary protrusion are abutted against each other, so that the rotary protrusion is turned. As the rotary protrusion is turned, the switch member is operated.

In the switch device, when the operating shaft is depressed, the elastic force (or operating force) of the return spring acting in response to the depression is scarcely changed. Therefore, the feeling of depression of the operating shaft is not dependent on the degree of depression: that is, the switch device is low in operability.

On the other hand, Examined Japanese Utility Model Publication Sho 53-2281 has disclosed a switch in which a shaft is pushed to turn a rotor, to perform a switching operation.

In the conventional switch, the shaft has a gear ring, which is engaged with a gear ring formed on the rotor side. The gear rings on the shaft side and on the rotor side have teeth of the same tangent (tan) curve, and are meshed with each other. The switch is provided with a spring which urges the shaft's gear ring and the rotor's gear ring to space them away from each other. That is, the switch is so designed that, when the shaft is pushed, the shaft's gear ring is engaged with the rotor's gear ring, to turn the rotor. When the shaft is pushed, the distribution of force is as follows; that is, first the force is small, then large, and finally small again. Thus is, the feeling of operation is dependent on the degree of depression. Hence, the degree of depression can be determined from the change in the feeling of operation. Thus, the switch is high in operability.

However, the shaft's gear ring, and the rotor's gear ring must have tangent curved teeth. However, the manufacture of those gear rings takes time and labor. Furthermore, since it is necessary to engag the teeth of the tangent curved gears, the assembling work takes time and labor.

In view of the foregoing, an object of the invention is to eliminate the above-described difficulties accompanying a conventional switch device. More specifically, an object of the invention is to provide an operating device which is simple in structure, and in which the feeling of operation is improved.

SUMMARY OF THE INVENTION

The foregoing object of the invention has been achieved by the provision of an operating device in which an operating element is provided in such a manner that the operating element can be depressed against a body, and the operating element is depressed to move the operating element in a direction of depression; which comprises:

an arcuate body-side guide section provided on the side of the body, in which a surface thereof includes a sloped surface, and a side surface thereof is a step;

an operating-element-side guide section provided on the side of the body element, being arcuate in correspondence to the body-side guide section, in which a surface thereof includes a sloped surface, and a side surface is a step, the operating-element-side guide section turning the operating element in response to the depression of the operating element; and a coil-shaped spring member which is arranged between the body and the operating element, the spring member normally urging the operating element in a direction opposite to the direction of depression, and having one end secured to the body and the other end secured to the operating element.

In the operating device of the present invention, the operating element is a bottomed cylinder, the spring member is arranged inside the cylinder, and the body-side guide section and the operating-element-side guide section are arranged in said spring member.

In the operating device of the present invention, a pair of the body-side guide sections, and a pair of the operating element guide sections are provided.

In the operating device of the present invention, the operating element has a cover member which abuts against the outer surface of the operating element to depress the operating element.

In the operating device of the present invention, the operating element has a drive section which is protruded from the body in response to the depression of the operating element, and the operating device is a switch device which is operated by the drive section.

In the operating device of the present invention, the operating element is so provided that it can be depressed with respect to the body, and when the operating element is depressed, it is moved in the direction of depression. When the operating element is depressed, first the operating element is moved against the elastic force of the spring, and soon the sloped surface of the operating-element-side guide section is abutted against the sloped surface of the body-side guide section, and the sloped surface of the operating-element-side guide section is turned along the sloped surface of the body-side guide section. In this operation, the force of operation acting when the operating element is depressed is the sum of the force of depression which depresses the spring in the direction of depression, a torsional force provided when the spring-member is twisted as the operating element turns, and a frictional force between the sloped surface of the operating-element-side guide section and the sloped surface of the body-side guide section.

When the operating element is further depressed, the operating element is further turned. Soon, the sloped surfaces of those guides section are disengaged from each other, and the operating element is moved straight not being turned. In this operation, the operating force is the force of depression of the spring member. Hence, when the operating-element side guide member is disengaged from the body-side guide member, the operating force is changed; that is, it is decreased.

In the operating device of the present invention, the operating element is in the form of a bottomed cylinder, and the spring member is arranged in the cylinder, and the body-side guide section and operating-element-side guide section are arranged inside the spring member. This feature makes it possible to make the operating device compact.

In the operating device of the present invention, a pair of the body-side guide section, and a pair of the operating-element-side guide sections are provided. Hence, the operating element can be more positively turned with respect to the body.

In the operating device of the present invention, the operating element is depressed as the cover member is depressed. For instance when the operator depresses the cover member, the operating element is depressed.

In the operating device of the present invention, the operating device is the switch device. As the operating element is depressed, the drive section is protruded from the body, thus performing a switching operation.

DETAILED DESCRIPTION OF THE PREFERRED EMBODIMENTS

An operating device, which constitutes an embodiment of the invention, will be described with reference to FIGS. 1 through 8.

Figure 1:
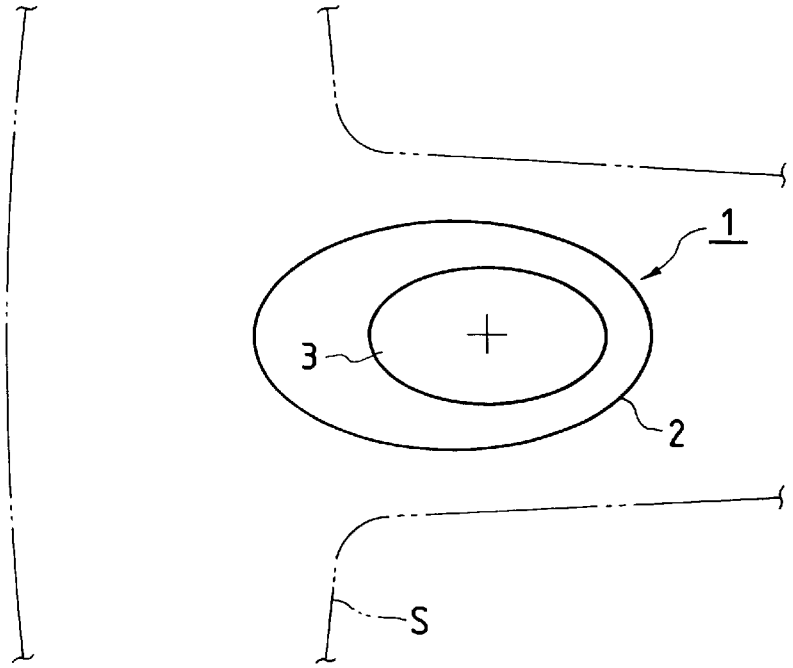
FIG. 1 is a front view of a switch device, which constitutes an embodiment of the invention.
Figure 2:
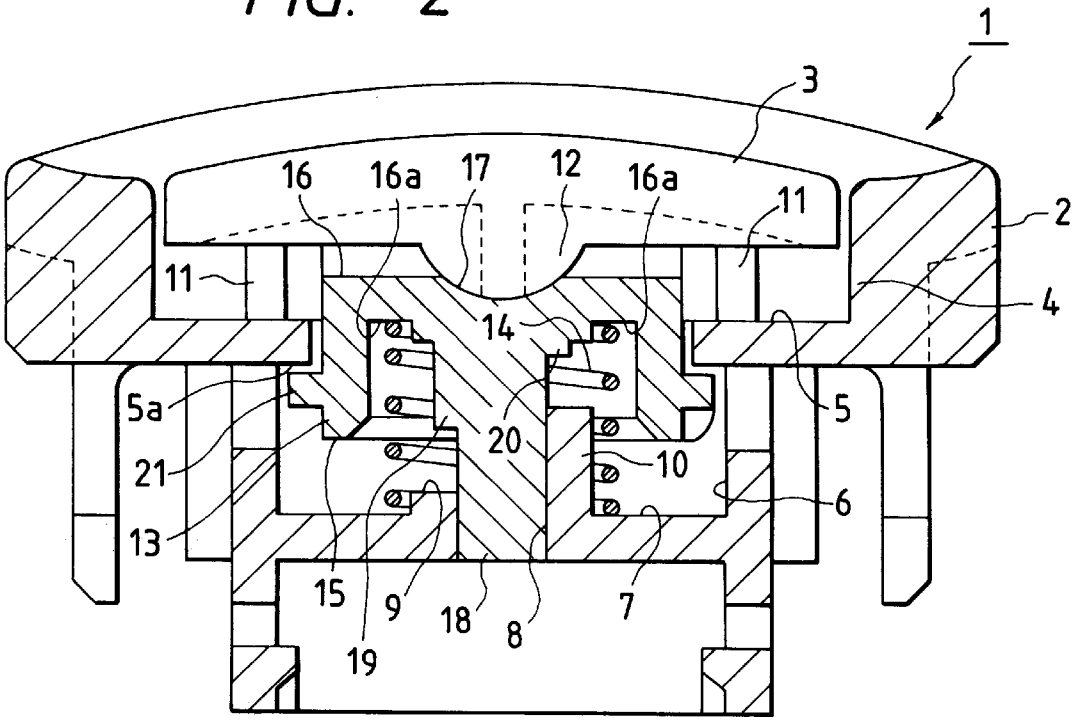
FIG. 2 is a sectional view of the switch device.

FIGS. 1 and 2 are a plan view and a sectional view, respectively showing a switch device provided as an operating device which is mounted on the spoke of the steering wheel of an automobile and performs a shifting operation.

The switch device 1 comprises: an outer frame 2 which is a body mounted on the spoke of the steering wheel S; and an operating knob 3 which is a cover member fitted in the outer frame 2.

The outer frame 2 has a first recess 4 in the upper surface which is conical. The bottom surface 5 of the first recess 4 has a second recess 6 substantially as the center. The bottom surface 7 of the second recess 6 has a circular through-hole 8. The through-hole 8 has first and second body-side protrusions 9 and 10 around it which form a body-side guide section.

Figure 3A:
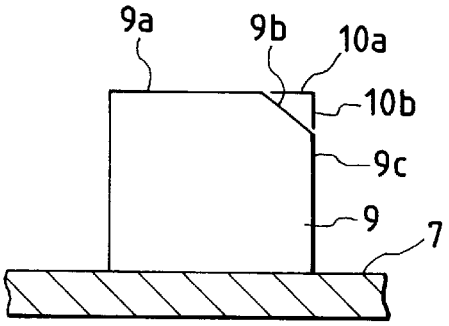
FIGS. 3(*a*) and (*b*) are a side vide and a front view, respectively, showing body-side portions.
Figure 3B:
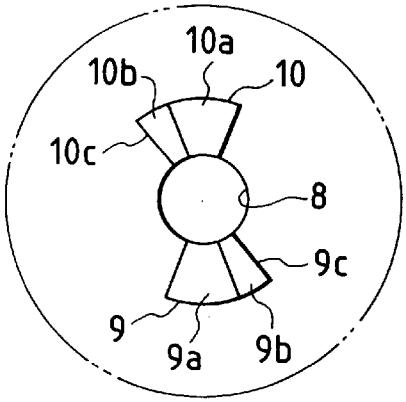

As shown in FIGS. 3(*a*) and (*b*) the first and second body-side protrusions 9 and 10 are formed arcuate around the through-hole 8. The first and second body-side protrusions 9 and 10 have predetermined angles (about 90°), and are arranged symmetrical with respect to the through-hole 8.

The upper end faces of the first and second body-side protrusions 9 and 10 include flat surfaces 9*a* and 10*a*, and sloped surfaces 9*b* and 10*b*, respectively. The flat surfaces 9*a* and 10*a* are in parallel with the bottom surface 7. The sloped surfaces 9*b* and 10*b* are inclined downwardly from the edges of the flat surfaces 9*a* and 10*a*. The side surfaces, on the sides of the sloped surfaces 9*b* and 10*b*, of the first and second body-side protrusions 9 and 10, are steps 9*c* and 10*c*, respectively. Those flat surfaces 9*a* and 10*a* are symmetrical with respective to the through-hole 8.

As shown in FIG. 2, the operating knob 3 is conical in conformance with the planar configuration of the first recess 4, and has four legs 11 at four corners which are extended downwardly. The operating knob 3 has a semi-spherical engaging protrusion 12 at the center of the lower surface.

The operating knob 3 is accommodated in the first recess 4, and the legs of the operating knob 3 are inserted into guide grooves (not shown) formed in the bottom 5 of the first recess 4. The operating knob 3 is vertically movable (being able to reciprocate) in the first recess 4. This vertical movement is positively achieved with the legs 11 moving in the guide grooves.

An operating element, namely, a rotor 13, and a spring member, namely, a spring 14 are provided between the operating knob 3 and the bottom 7 of the second recess 6.

The rotor 13 includes a cylinder 15, and the upper end of which is closed with an upper plate 16. The upper plate 16 has an engaging recess 17 at the center, which is engaged with the semi-spherical engaging protrusion 12 of the operating knob 3.

A drive section, namely, a cylindrical rod 18 is extended downwardly from the lower surface of the upper plate 16 of the rotor 13. The rod 18 has a first operating-element-side protrusion 19, and a second operating-element-side protrusion 20 around it, which form an operating-element-side guide section.

Figure 4A:
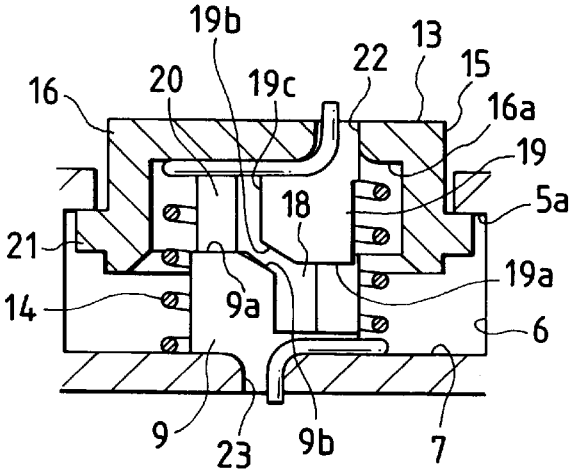
FIGS. 4(*a*) and (*b*) are a sectional view and a front view, respectively, showing the assembling work of the switch device.
Figure 4B:
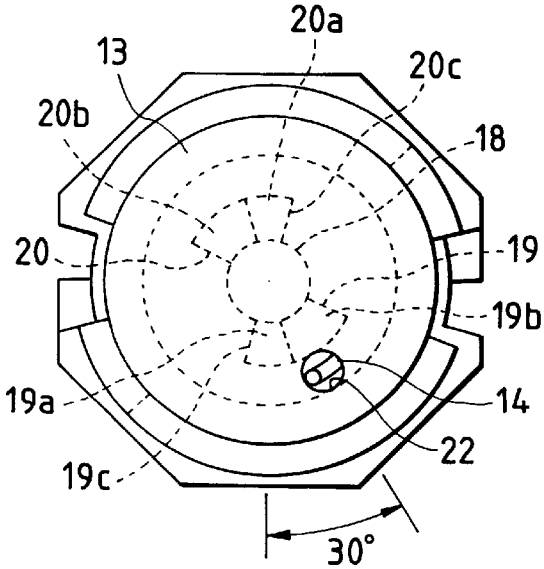

As shown in FIGS. 4(*a*) and (*b*) show the first and second operating-element-side protrusions 19 and 20 are formed arcuate around the rod 18. The first and second operating-element-side protrusions 19 and 20 have a predetermined angle (about 90°), and are symmetrical with respect to the center of the rod 18.

The lower end faces of the first and second operating-element-side protrusions 19 and 20 have flat surfaces 19*a* and 20*a*, and sloped surfaces 19*b* and 20*b*, respectively. The flat surfaces 19*a* and 20*a* are in parallel with the bottom surface 7. The sloped surfaces 19*b* and 20*b* are inclined obliquely outwardly from the edges of the flat surfaces 19*a* and 20*a*, respectively. Those sloped surfaces 19*b* and 20*b* are symmetrical with respect to the center of the rod 18. The side surfaces, on the sides of the sloped surfaces 19*b* and 20*b*, of the first and second operating-element-side protrusions 19 and 20, are steps 19*c* and 20*c*. The rotor 13 has an annular locking ring 21 around the cylindrical outer surface.

The rotor 13 is so arranged that its locking ring 21 is accommodated in the second recess 6; that is, the locking ring 21 is arranged below the lower surface 5*a* of the member which forms the bottom surface 5 of the first recess 4. The rod 18 of the rotor 13 is inserted into the through-hole 8.

The aforementioned spring 14 is provided between the lower surface 16*a* of the upper plate 16 of the rotor 13 and the bottom surface 7 of the second recess 6. The upper plate 16 has a locking hole 22 to fixedly hold the upper end of the spring 14. Similarly the bottom surface 7 of the second recess 6 has a locking hole 23 to fixedly hold the lower end of the spring 14. The upper end and the lower end of the locking spring 14 are inserted into the locking holes 22 and 23, respectively, to fix the spring 14.

FIGS. 4(*a*) and (*b*) show the rotor 13 which is being combined with the outer frame 2. At the time of combination of the rotor with the outer frame 2, with the rotor 13 turned against the elastic force of the spring 14 to the position which is shifted a predetermined angle from the reference position of the locking hole 22, a part of the rotor 13 is inserted into the second recess 6. And when the turning force is decreased, as shown in FIG. 4(*a*), the locking ring 21 is abutted against the lower surface 5*a* of the first recess 4.

Figure 5A:
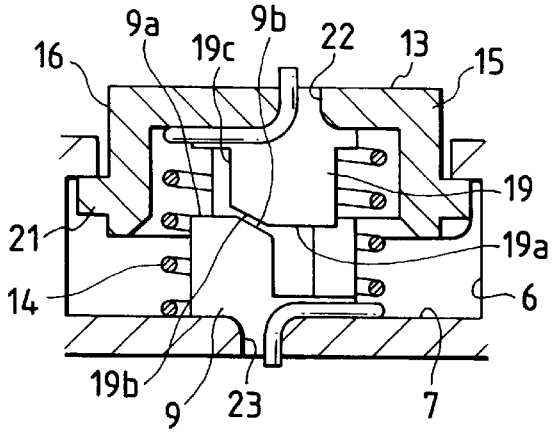
FIGS. 5(*a*), (*b*) and (*c*) are a sectional view, a front view, and a sectional view, respectively, showing the function of the switch device.
Figure 5B:
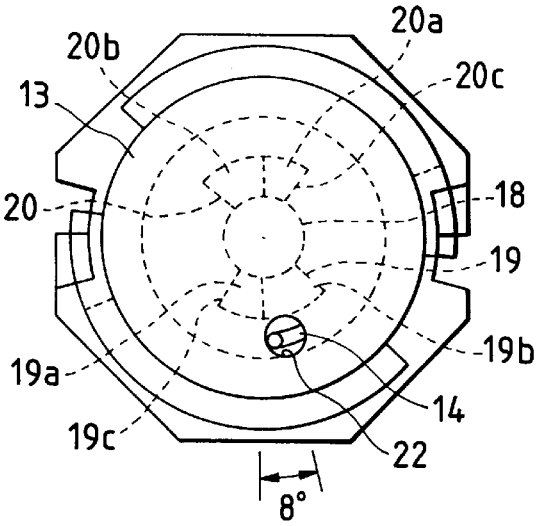
Figure 5C:
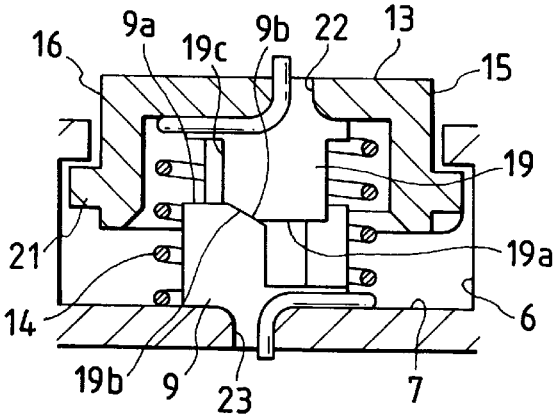

Under this condition, the sloped surface 9*b* of the first body-side protrusion 9 and the sloped surface 19*b* of the first operating-element-side protrusion 19 are spaced from each other, confronting with each other. When the rotor 13 is set free being combined with the outer frame 2, as shown in FIG. 5(*a*), the sloped surface 9*b* of the first body-side protrusion 9 and the sloped surface 19*b* of the first operating-element-side protrusion 19 are set close to each other confronting with each other. In this case, the locking hole 22 of the rotor 13, as shown in FIG. 5(*b*), is shifted angularly about 8° from the reference position.

Now, the function and effect of the switch device thus constructed will be described.

In the case where the switch device 1 is not operated by the operator; that is, in the case where it is in ordinary state, it is as shown in FIGS. 5(*a*) and (*b*). When, under this condition, the operating knob 3 is depressed, the operating knob 3 is moved in the direction of depression against the elastic force of the spring 14, and, as shown in FIG. 5(*c*), the sloped surfaces 9*b* and 19*b* are abutted against each other. During this operation, the rotor 13 is not turned, and as shown in FIG. 5(*b*) the position of the locking hole 22 is turned angularly about 8° from the reference position.

The operating force used for the period of time which elapses from the time instant that the operation (depression) of the operating knob 3 is started until the sloped surfaces 9*b* and 19*b* are abutted against each other corresponds to the force of depression acting in the direction of depression of the spring 14. As the amount of operation increases, the operating force is also increased.

When, under the condition that, as shown in FIGS. 5(*b*) and (*c*) the sloped surfaces 9*b* and 19*b* are abutted against each other, the operating knob 3 is further depressed, the sloped surface 19*b* is slid on the sloped surface 9*b*, so that the rotor 13 is turned counterclockwise, thus twisting the spring 14, and the rotor 13 is moved in the direction of depression, thus depressing the spring 14. In this case, the operating force used when the operating knob 3 is depressed, is the sum of a force of depression acting in the direction of depression of the spring 14, a torsional force attributing to the torsion of the spring 14, and frictional forces acting when the sloped surfaces 19*b* and 20*b* are slid on the sloped surfaces 9*b* and 10*b*. The depression force and the torsional force are increased as the amount of operation increases (an interval Y2 in FIG. 8).

Therefore, at the border X1 between the interval Y1 and the interval Y2, the operating force is greatly changed. That is, at the border X1, the operating force is increased as much as the sum of the torsional force attributing to the torsion of the spring 14, and the frictional forces acting when the sloped surfaces 19*b* and 20*b* are slid on the slope surfaces 9*b* and 10*b*.

Figure 6A:
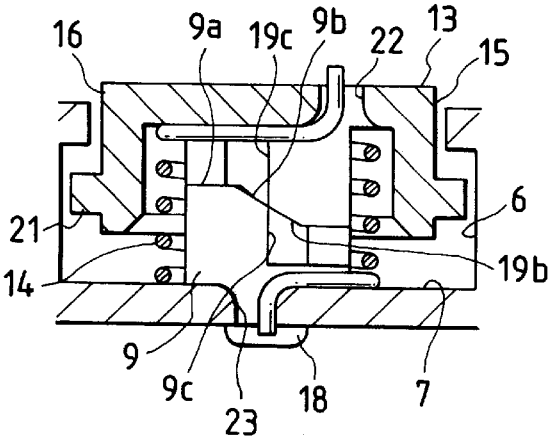
FIGS. 6(*a*) and (*b*) are a sectional view and a front view, respectively, showing the function of the switch device.
Figure 6B:
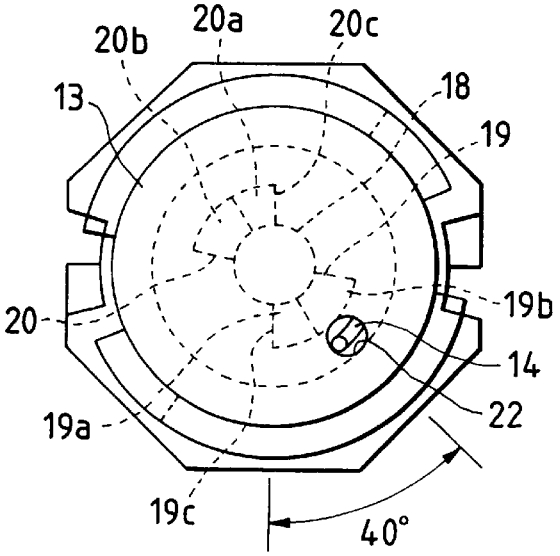
Figure 7A:
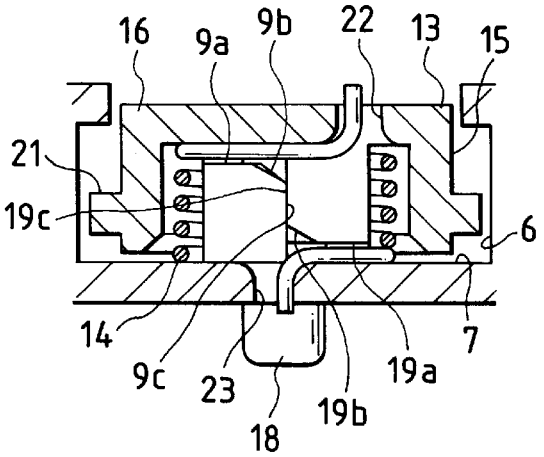
FIGS. 7(*a*) and (*b*) are a sectional view and a front view, respectively, showing the function of the switch device.
Figure 7B:
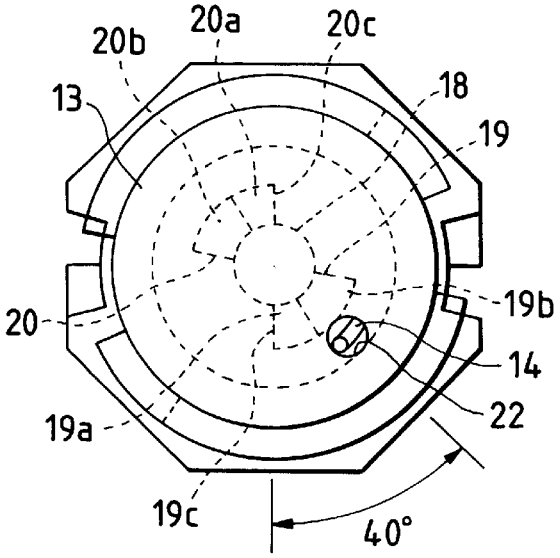
Figure 8:
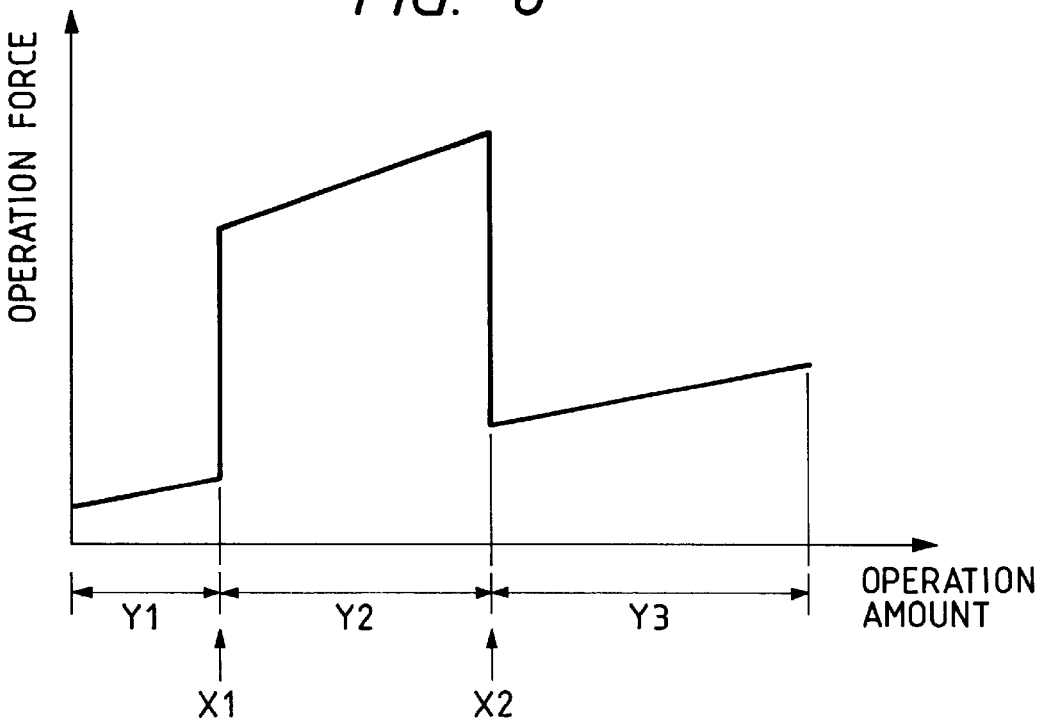
FIG. 8 is a graphical representation indicating operating forces with amounts of operation.

When, under the condition shown in FIGS. 5(*b*) and (*c*), the operating knob 3 is further depressed, soon as shown in FIGS. 6(*a*) and (*b*) the slopes surfaces 19*b* and 9*b* are disengaged from each other. In this case, the locking hole 22 is shifted angularly about 40° from the reference position. In this case, the frictional forces of the sloped surfaces 19*b* and 20*b* and the slopes 9*b* and 10*b* are eliminated, while the torsional force of the spring 14 is also eliminated. Hence, the operating force is greatly decreased. When the operating knob 3 is further kept depressed, as shown in FIGS. 7(*a*) and (*b*) the steps 9*c* and 19*c* of the first operating-element-side protrusion 19 and the first body-side protrusion 9 are abutted against each other, so that the rotor 13 is moved in the direction of depression, not being turned. In this case, the operating force acting when the operating knob 3 is depressed is only the force of depression of the spring 14. The force of depression is proportional to the amount of operation (the interval Y3 in FIG. 8).

Hence, at the border X2 between the intervals Y2 and Y3 (FIG. 8) the operating force is greatly changed. That is, at the border X1, the operating force is decreased (changed) as much as the sum of the frictional forces of the slopes surfaces 19*b* and 20*b* and the sloped surfaces 9*b* and 10*b*, and the torsional force of the spring 14.

When the switch device designed as described above is operated as shown in FIGS. 5(*a*) and (*b*) through FIGS. 7(*a*) and (*b*), the rod 18 is protruded downwardly through the through-hole 8 as the rotor 13 moves in the direction of depression. In this operation, the rod 18 thus protruded pushes, for instance, the on-off terminal of a switch; that is, a switching operation is carried out.

The above-described embodiment has the following effects (a) through (f):

(a) The upper end of the spring 14 is secured to the rotor 13, while the lower end is secured to the outer frame 2. Hence, in the case where the sloped surfaces 19*b* and 20*b* slide on the sloped surfaces 9*b* and 10*b*, and the rotor 13 is turned, the frictional forces between the sloped surfaces 19*b* and 20*b* and the sloped surfaces 9*b* and 10*b*, the force of depression of the spring 14, and the torsional force of the spring 14 act. Therefore, the changes at the border lines X1 and X2 are increased; that is, when the operating knob is depressed, the operation of the latter feels clear. Hence, the operator of the switch device 1 can determine the degree of operation from the feeling of operation of the operating knob 3.

(b) The rotor 13 is in the form of a cylinder. The spring 14 is arranged in the cylinder, and the operating element-side protrusions 19 and 20, and the body-side protrusions 9 and 10 are arranged inside the spring 14, which makes the switch device 1 compact.

(c) The rotor 13 has a pair of operating-element side protrusions 19 and 20, and the outer frame 2 has a pair of body-side protrusions 9 and 10. Hence, when the operating knob 3 is depressed, the rotor can be stably rotated. That is, the switch device is improved in operability.

(d) The operating knob 3 has an engaging protrusion 12 in the lower surface, while the rotor 13 has the engaging recess 17 in the upper surface. The engaging protrusion 12 is engaged with the engaging recess 17. Hence, when the operating knob 13 is depressed, the rotor 3 is turned around the engaging protrusion 12; that is, the rotor 13 is turned more stably.

(e) When the operating knob 3 is depressed, the rod is protruded from the outer frame 2, to perform the switching operation. Hence, in the switching operation, the operating knob 3 is positively operated.

(f) The upper and lower ends of the spring 14 are inserted into the locking holes 22 and 23, respectively; that is, the spring 14 is secured to the outer frame 2 and the rotor 13, and accordingly the spring 14 can be readily secured to the outer frame 2 and the rotor 13.

While there has been described in connection with the preferred embodiment of the invention, -the latter is not limited thereto or thereby; that is, it will be obvious to those skilled in the art that various changes and modifications may be made therein without departing from the invention for instance as follows:

(1) In the above-described embodiment, a spring which is different in elastic force from the aforementioned spring 14 may be employed. That is, by the employment of a spring different in elastic force from the spring 14 makes it possible to change the operating force or the feeling of operation of the operating knob 3 (the switch device 1) with ease.

(2) In the above-described embodiment, the angles of inclination of the sloped surfaces 9*b* and 10*b* and the sloped surfaces 19*b* and 20*b* may be set to other suitable values. This changes the frictional force in the interval Y2 and the feeling of operation of the operating knob 3.

(3) In the above-described embodiment, a plurality of locking holes 22 adapted to fix the upper end (on the rotor side) of the spring 14 may be formed along a circle. In this modification, the upper end of the spring 14 can be inserted into a desired one of the locking holes 22.

(4) In the above-described embodiment, the body-side protrusions 9 and 10, and the operating-element-side protrusions 19 and 20 may be arranged outside the spring 14.

(5) The above-described embodiment may be modified as follows: In the above-described body-side protrusions 9 and 10, and the operating-element-side protrusions 19 and 20, the flat surfaces 9*a*, 10*a*, 19*a* and 20*a* are not formed, and instead only the sloped surfaces 9*b*, 10*b*, 19*b* and 20*b* remain.

(6) In the above-described embodiment, the body-side and operating-element-side guide sections are protrusions. However, the embodiment may be so modified that one of the sections is a protrusion, and the other is a groove.

(7) When the switch 1 is not operated by the operator or the like; that is, when it is in ordinary state, the amount of (angular) shift of the locking hole 22 of the rotor 13 from the reference position is not limited to about 8° only; that is, it may be set to another suitable value. In addition, when the sloped surface 19*b* is disengaged from the sloped surface 9*b*, the amount of (angular) shift of the locking hole 22 is not limited to about 40°; that is, it may be set to another suitable value.

(8) When the switch 1 is not operated by the operator or the like; that is, when it is in ordinary state, the sloped surface 19*b* may be abutted against the sloped surface 9*b*. When, in this modification, the operator or the like depresses the operating knob 3, the rotor 13 starts turning immediately, and the operating force to depress the operating knob 3 is the sum of the force of depression acting in the direction of depression of the spring 14, the torsional force attributing to the torsion of the spring 14, and the frictional forces acting when the sloped surfaces 19*b* and 20*b* slide on the sloped surfaces 9*b* and 10*b*. This is equivalent to the fact that in FIG. 8 the interval Y1 and border X1 are eliminated.

Among the technical concepts understood from the above-described embodiment, ones other than those claimed will be described together with its effects:

(1) In the operating device of the present invention, the abutting (engaging) section between, the operating element, namely, the rotor 13 and the cover member, namely, the operating knob 3 is spherical. The surface of the rotor 13 through which the rotor 13 is engaged with the operating knob 3 is spherical, and therefore the rotor 13 can readily turn with respect to the operating knob. 3.

As is apparent from the above description, the spring member is secured to the operating element and the body. Hence when the operating element is operated, the sloped surface of the operating-element-side guide section is abutted against the sloped surface of the body-side guide section. The operating force acting when the sloped surface of the operating-element-side guide section turns along the sloped surface of the body-side guide section is the sum of the force of depression which depresses the spring in the direction of depression, a torsional force provided when the spring member is twisted as the operating element turns, and the frictional force between the sloped surface of the operating-element-side guide section and the sloped surface of the body-side guide section. Hence, the operating element is more positively operated (the feeling of operation being improved).

In the operating device of the present invention, the operating element is in the form of a bottomed cylinder, and the spring member is arranged in the cylinder, and the body-side guide section and operating-element-side guide section are arranged inside the spring member. This feature makes it possible to make the operating device compact.

In the operating device of the present invention, a pair of the body-side guide section, and a pair of the operating-element-side guide sections are provided. Hence, the operating element can be more positively turned with respect to the body.

In the operating device of the present invention, the operating element is depressed through the cover member.

In the operating device of the present invention, in performing the switching operation, the operating element can be more positively operated.

What is claimed is:

1. An operating device comprising:

an operating element that can b depressed against a body, said operating element being depressed to move in a direction of depression;

an arcuate body-side guide section provided on a side of said body, said body-side guide section including a sloped surface and a side surface, the side surface being a step;

an operating-element-side guide section provided on a side of said operating element, said operating-element-side guide section being arcuate in correspondence to said body-side guide section and including a sloped surface and a side surface, the side surface being a step, said operating-element-side guide section turning said operating element in response to the depression of said operating element; and a coil-shaped spring member arranged between said body and said operating element, said spring member normally urging said operating element in a direction opposite to the direction of depression, and having one end secured to said body and another end secured to said operating element, wherein said operating element is a bottomed cylinder, said spring member is arranged inside said cylinder, and said body-side guide section and said operating-element-side guide section are arranged in said spring member.

2. The operating device as claimed in claim 1, wherein said operating element has a drive section which protrudes from said body in response to the depression of said operating element.

3. The operating device as claimed in claim 1, wherein said body-side guide section includes a pair of sections, and said operating-element-side guide section includes a pair of sections.

4. The operating device as claimed in claim 3, wherein said operating element has a drive section which protrudes from said body in response to the depression of said operating element.

5. The operating device as claimed in claim 1, wherein said operating element has a cover member which abuts against an outer surface of said operating element to depress said operating element.

6. The operating device as claimed in claim 5, wherein said operating element has a drive section which protrudes from said body in response to the depression of said operating element.

7. An operating device comprising:

an operating element that can be depressed against a body, said operating element being depressed to move in a direction of depression;

an arcuate body-side guide section provided on a side of said body, said body-side guide section including a sloped surface and a side surface, the side surface being a step;

an operating-element-side guide section provided on a side of said operating element, said operating-element-side guide section being arcuate in correspondence to said body-side guide section and including a sloped surface and a side surface, the side surface being a step, said operating-element-side guide section turning said operating element in response to the depression of said operating element; and a coil-shaped spring member arranged between said body and said operating element, said spring member normally urging said operating element in a direction opposite to the direction of depression, and having one end secured to said body and another end secured to said operating element.

8. The operating device as claimed in claim 7, wherein said operating element has a drive section which protrudes from said body in response to the depression of said operating element.

9. The operating device as claimed in claim 7, wherein said operating element has a cover member which abuts against an outer surface of said operating element to depress said operating element.

10. The operating device as claimed in claim 9, wherein said operating element has a drive section which protrudes from said body in response to the depression of said operating element.

11. The operating device as claimed in claim 7, wherein said body-side guide section includes a pair of sections, and said operating-element-side guide section includes a pair of sections.

12. The operating device as claimed in claim 11, wherein said operating element has a drive section which protrudes from said body in response to the depression of said operating element.

13. The operating device as claimed in claim 11, wherein said operating element has a cover member which abuts against an outer surface of said operating element to depress said operating element.

14. The operating device as claimed in claim 13, wherein said operating element has a drive section which protrudes from said body in response to the depression of said operating element.

15. An operating device comprising:

an operating element that can be depressed against a body, said operating element being depressed to move in a direction of depression;

a body-side guide section provided on a side of said body, said body-side guide section including a sloped surface and a side surface;

an operating-element-side guide section provided on a side of said operating element, said operating-element-side guide section including a sloped surface and a side surface, said operating-element-side guide section turning said operating element in response to the depression of said operating element; and a spring member arranged between said body and said operating element, said spring member normally urging said operating element in a direction opposite to the direction of depression, and having one end secured to said body and another end secured to said operating element, wherein said operating element is a bottomed cylinder, said spring member is arranged inside said cylinder, and said body-side guide section and said operating-element-side guide section are arranged in said spring member.

16. The operating device as claimed in claim 15, wherein said operating element has a drive section which protrudes from said body in response to the depression of said operating element.

17. The operating device as claimed in claim 15, wherein said body-side guide section includes a pair of sections, and said operating-element-side guide section includes a pair of sections.

18. The operating device as claimed in claim 17, wherein said operating element has a cover member which abuts against an outer surface of said operating element to depress said operating element.

19. The operating device as claimed in claim 18, wherein said operating element has a drive section which protrudes from said body in response to the depression of said operating element.

20. The operating device as claimed in claim 17, wherein said operating element has a drive section which protrudes from said body in response to the depression of said operating element.

* * * * *